United States Patent [19]

Old, Sr.

[11] Patent Number: 4,941,312

[45] Date of Patent: Jul. 17, 1990

[54] BRIDLE BIT

[76] Inventor: Ralph N. Old, Sr., Rte. 3, Box 311, Smithville, Tenn. 37166

[21] Appl. No.: 296,949

[22] Filed: Jan. 17, 1989

[51] Int. Cl.[5] ..... B68B 1/06

[52] U.S. Cl. ..... 54/8

[58] Field of Search ..... 54/7, 8, 9

[56] References Cited

U.S. PATENT DOCUMENTS

| | | | |
|---|---|---|---|
| 31,557 | 2/1861 | Roberds | 54/7 |
| 800,381 | 9/1905 | Malke | 54/8 |
| 3,208,196 | 8/1965 | Ferguson | 54/8 |
| 3,851,446 | 12/1974 | Bischeltsrieder | 54/8 |

*Primary Examiner*—Robert P. Swiatek

*Attorney, Agent, or Firm*—Harrington A. Lackey

[57] ABSTRACT

A bridle bit including a bit member having its outer ends coupled to a pair of bow-shaped connector members journaled to the shafts of a pair of rein lever members to permit free pivotal and elevational movement of the bit member in the horse's mouth. The bow-shaped members are connected to sleeves journaled on the rein lever shafts and are adapted to be vertically adjusted on the shaft and retained in the adjusted positions by the corresponding placement of tubular spacer members on the shaft, either above or below the journal sleeves. The bit member further includes detachable weights at the outer ends of the bit member to permit the bit member to assume different positions in the horse's mouth.

12 Claims, 2 Drawing Sheets

BRIDLE BIT

BACKGROUND OF THE INVENTION

This invention relates to a bridle bit, and more particularly to an adjustable bridle bit.

Solid, unitary bits, such as curb bits as well known in the art of bridles.

Also, known in the art are broken snaffle bits, such as those disclosed in the following U.S. Pat. Nos.:

| | | |
|---|---|---|
| 109,145 | Roberts | Nov. 8, 1870 |
| 804,700 | Bethe | Nov. 14, 1905 |
| 3,623,294 | Stone et al | Nov. 30, 1971 |
| 3,628,308 | Lozier | Dec. 21, 1971 |

The Welton U.S. Pat. No. 3,478,493, issued Nov. 18, 1969 and the above Lozier patent disclose different types of rein levers, the upper ends of which terminate in chin strap eyes connected by a chin strap or curb chain. Furthermore, the Welton patent discloses rein levers which are adjustable in length and have detachable rein eyes.

The Lozier patent discloses rein levers having straight bars and forward projecting arcuate shank portions to which the outer end portions of the bit bars are journaled for up and down movement along the arcuate shank portions. However, the arcuate shank portions are a rigid part of the rein levers. The cross bars 10 in the rein levers of the Lozier patent limit the elevational movement of the outer end portions of the bit bars relative to the rein levers.

SUMMARY OF THE INVENTION

It is therefore an object of this invention to provide a bridle bit including a bit member which is connected to a pair of rein levers with means which provide versatile movement for the bit member, in order to provide better control over and comfort of the horse.

Another object of this invention is to provide a bridle bit member connected to the rein levers, not only for versatile mobility, but also for vertical adjustment and positioning relative to the rein levers.

A further object of this invention is to provide rein levers having elongated shafts of uniform cross section for receiving the journal sleeves of a pair of bow-shaped connector members to which the outer ends of the bit member are coupled for both pivotal and axial movement along the shanks of the connector members.

A further object of this invention is to provide connector members to which the outer ends of a bit member are coupled for both pivotal and axial movement and in which the connector members are adjustably positioned upon the elongated shafts of the rein levers and held in such position by detachable and interchangable tubular spacers.

Another object of this invention is to provide a bit member which has a floating action relative to the rein levers not only to provide more comfort for the horse, but also to prevent the horse from setting his jaw against the bit member, and to provide more adequate control of the horse's head.

Another object of this invention is to provide a bit member having counterweights detachably connected to the outer ends of the bit member to enable the bit member to assume different attitudes within the horse's mouth, and particularly to place the bit member high on the horse's tongue for comfort.

DESCRIPTION OF THE PREFERRED EMBODIMENTS

Figure 1:
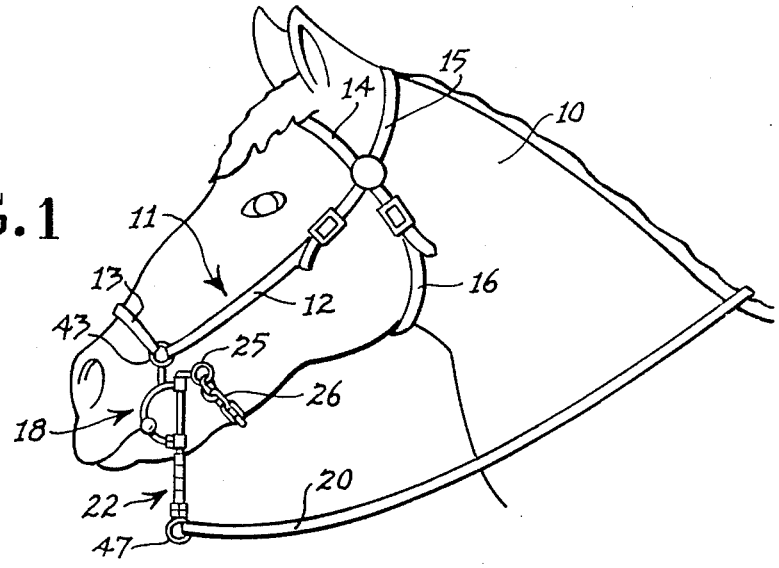
FIG. 1 is a side elevational view of a bridle mounted on a horse's head and incorporating the bit made in accordance with this invention in a normal position.

Referring now to the drawings in more detail, FIG. 1 discloses a horse's head 10 upon which is mounted a bridle 11 having a check piece 12, a nose band 13, a brow band 14, a head stall strap 15, and a throat latch 16. The bridle bit 18 made in accordance with this invention is connected to the cheek piece 12 and also to the reins 20. The bridle bit 18 made in accordance with this invention includes a pair of rein lever members 21 and 22, each of which is constructed of an elongated, preferably straight shaft or bar 23 of uniform cross-section. The upper end portion of each shaft 23 forms a rearward directed ring bar 24 terminating in a curb chain ring 25. Connected to the curb chain rings 25 is an elongated flexible chin strap or curb chain 26.

Supported upon the opposed vertical shafts of the rein lever members 21 and 22 is a bit member or mouthpiece, such as the broken snaffle bit member 28 including a pair of bit bars 29 and 30 having their respective inner end portions terminating in interconnecting loop members 31 and 32. The outer end portions of the bit member, such as the bit bars 29 and 30, terminate in coupling members such as the collars 33 and 34, respectively. Each collar 33 and 34 is provided with a hole for slidably and pivotally receiving the corresponding bow-shaped or arcuate shanks 35 and 36 of connector members 37 and 38.

Figure 2:
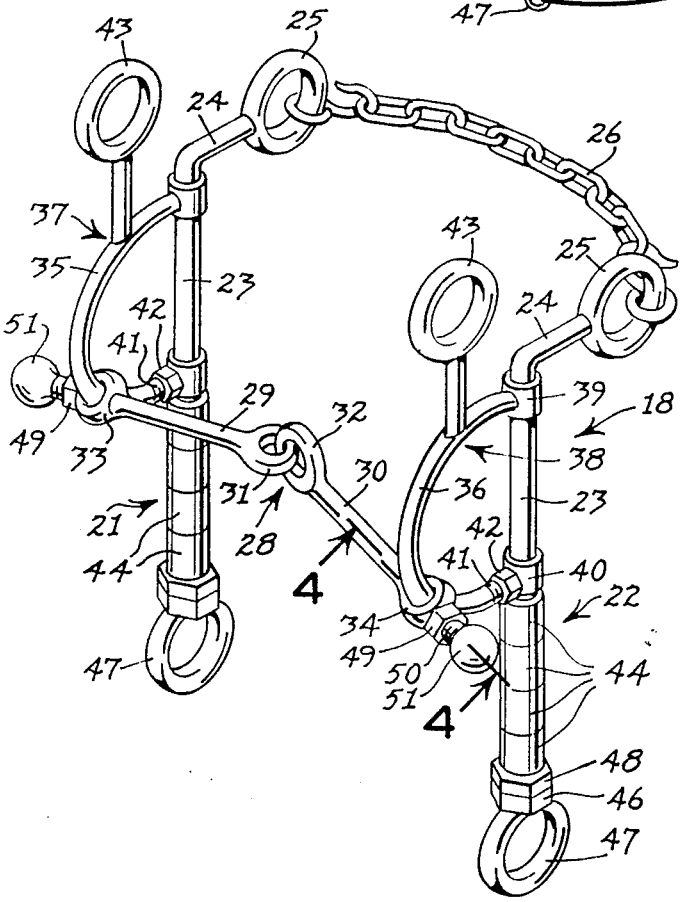
FIG. 2 is a top front perspective view of the bridle bit made in accordance with this invention detached from the other parts of the bridle.
Figure 7:
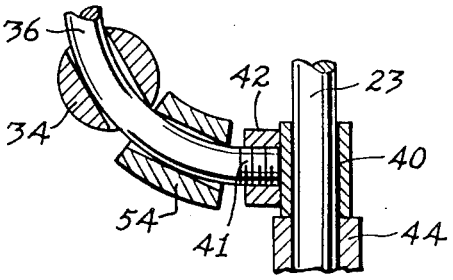
FIG. 7 is an enlarged fragmentary sectional view of the lower portion of the connector member disclosed in FIG. 6.

The free ends of the bow-shaped shanks 35 and 36 terminate in corresponding upper sleeves 39 and lower sleeves 40 slidably receiving the corresponding shafts 23 of the respective rein lever members 21 and 22, for relative axial and pivotal movement. While the upper ends of the bow-shaped shanks 35 and 36 are rigidly fixed with, or integral with, the upper sleeves 39, the lower ends of the shanks 35 and 36 are threaded at 41 for threaded engagement with the corresponding nuts 42 fixed, such as by welding, to the lower sleeves 40, as best illustrated in FIGS. 2 and 7. The threaded end 41 and the nut 42 permit separation of the bow-shaped shanks 35 and 36 from their lower sleeves 40 in order to remove or replace the bit member, such as the corresponding bit bars 29 and 30.

Preferably fixed to the upper portions of the bow-shaped shanks 35 and 36 are a corresponding pair of bridle eyes 43 to which are connected the cheek piece 12 and the nose band 13 of the bridle 11, as illustrated in FIG. 1.

Figure 3:
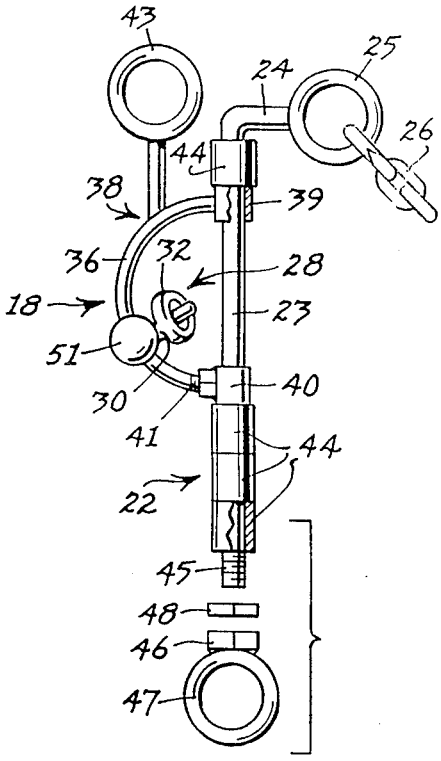
FIG. 3 is a side elevational view of the bit disclosed in FIG. 2, with portions broken away, and with the rein eye detached.

It will be noted in FIGS. 2 and 3 that the rein lever shafts 23 are substantially longer than the distance between the upper and lower sleeves 39 and 40. Thus, each of the connector members 37 and 38 may be longitudinally or vertically shifted along each corresponding shaft 23 to various positions, in order to adjustably mount the bit member 28 in various vertical relationships to the corresponding rein levers 21 and 22.

The connector members 37 and 38 may be held in their vertically adjusted position along the elongated shafts 23 by means of short tubular spacers 44. As disclosed in FIGS. 2 and 3, four spacers 44 are shown all mounted end-to-end along the shaft 23 below the lower sleeve 40 to hold the connector member 37 and 38 in their uppermost positions along the rein lever shafts 23.

The lower or bottom end of each shaft 23 is provided with a depending threaded stud 45 adapted to threadedly receive the nut 46 integrally connected, such as by welding, to the rein eye 47. The threaded nut 46 is held in its threaded position upon the stud 45 by a lock nut 48. The rein eye 47, after it is assembled upon its corresponding rein lever shaft 23, is connected to the rein 20, as illustrated in FIG. 1.

When it is desired to lower the relative position of the connector members 37 and 38 upon the rein lever shaft 23, the rein eyes 47 and their nuts 46 are unthreaded from the studs 45, and the spacers 44 and the sleeves 39 and 40 are removed entirely from each corresponding shaft 23. Then one or more of the tubular spacers 44 is moved axially upward along the corresponding shaft 23. The corresponding connector members 37 and 38 are installed upon the corresponding shafts 23 by inserting each shaft 23 through the corresponding upper and lower sleeves 39 and 40, and the remaining spacers 44 are moved coaxially over the shaft 23 beneath the lower sleeves 40. The rein eye 47 is then threadedly secured to the stud 45 to lock the spacers 44 and the connector members 37 and 38 in their new vertical positions on the rein lever shafts 23.

Also, in a preferred form of the invention, a threaded nut, recess or well 49, is formed or fixed on the outer end portion of each of the collars 33 and 34. Each threaded well 49 threadedly receives an externally threaded member 50 forming an integral part of a counterweight 51. These counterweights 51 may be made in multiples of different weights. Each counterweight 51 has a threaded member 50 of the same dimension, so that it is readily interchangable with any other counterweight of different values on the outer end portions of the bit member, such as the bit bars 29 and 30. The counterweights 51 cause the inner end portions of the bit bars 29 and 30 to pivot upward at different angles, depending upon the values of the counterweights 51.

It will be observed, particularly in FIG. 2, that the collars 33 and 34 permit the bit member, such as the bit bars 29 and 30, to freely rotate about the central longitudinal axis of the arcuate shanks 35 and 36, as well as to slide up and down along the shanks 35 and 36. Moreover, the journal sleeves 39 and 40 permits the connector members 37 and 38 to swing inward and outward, toward and away from each other about the longitudinal axes of their corresponding rein lever shafts 23. Thus, the bit member 28 is capable of versatile adjustment and movement, particularly when installed in the horse's mouth. Accordingly, the horse may move its mouth as well as its tongue and jaws to create corresponding movements in the bit member 28.

Furthermore, when the reins 20 are pulled taut, the rein lever members 21 and 22 will be pivoted rearwardly partially about the bridle eyes 43, and also about the bit member 28. Such pivotal movement of the rein levers 21 and 22 will cause some movement of the bit member 28 along the arcuate shanks 35 and 36, and possibly some movement of the connector members 37 and 38 toward each other, as the bit member 28 flexes. Moreover, when the rein eyes 36 are pulled rearwardly, the curb chain 26 is pulled forward against the jaw of the horse's head 10 to create pressure against the jaws for control.

Figure 5:
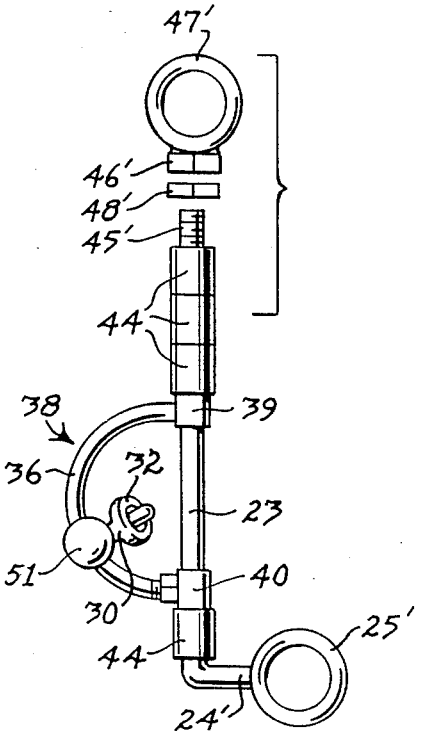
FIG. 5 is a side elevational view of a modified bit in which the rein lever shaft is upside down from its position disclosed in FIG. 3 and the bridle eye has been removed from the bow-shaped shank.
Figure 4:
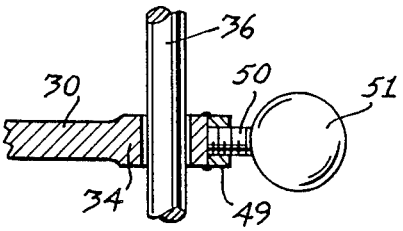
FIG. 4 is an enlarged fragmentary section taken along the line 4—4 of FIG. 2.

FIG. 5 discloses a modification of the bit in which the bridle eyes 43 have been removed from the bow-shaped connector shanks 35 and 36, and in which the shaft 23 of each of the rein levers 21 and 22 has been turned upside down. Thus, as disclosed in FIG. 5, a curb chain eye 25 has been converted into a rein eye 25', while the rein eye 47 has been converted into a bridle eye 47'. In this modification, no curb chain is employed.

Moreover, as disclosed in FIG. 5, each of the bow-shaped connector members, such as 38, has been positioned on the lower portion of the corresponding rein lever shaft 23 by first positioning a single spacer 44 on the lower end of the shaft 23, then inserting the bow-shaped connector member 38 and then installing three more spacers 44 above the connector 38 before attaching the bridle eye 37' upon the threaded post 45'.

Figure 6:
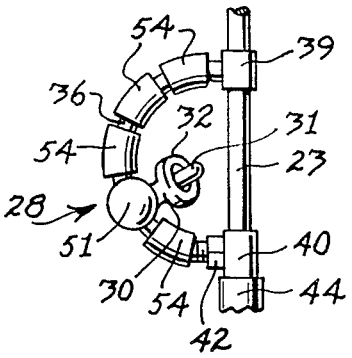
FIG. 6 is a fragmentary side elevational view of the bow-shaped connector member incorporating a plurality of spacer members on the shank.

In FIG. 6, the bit member 28 has been limited in its movement axially along each arcuate bow-shaped shank 35 and 36 by means of a set of a plurality of bit spacers 54. The bit spacers 54 are added or removed by separation of the threaded end portion 41 from the nut 42 on the lower sleeve 40, so that the bit member 28 may be located in its desired elevation relative to the bow-shaped shank 35 and 36. Moreover, the spacers 54 limit the degrees of travel of the bit member 28 within the horse's mouth.

Therefore, by virtue of the various articulations between the bit member 28, the connector members 37 and 38 and the rein levers 21 and 22, the floating action of the bit member 28 is permitted within the horse's mouth to maximize both control and comfort of the horse.

The movement of the mouthpiece 28 in response to either the movement of the horse's mouth or the pull on the reins 20 will cause the horse's mouth to be lubricated with saliva.

The horse may be maintained in the desired gait more easily because of the flexibility of movement of the various parts of the bridle bit 18 made in accordance with this invention.

The counterweight members 50 also tend to maintain the bit member 28 higher on the horse's tongue in order to make the horse more comfortable.

What is claimed is:

1. A bit for a bridle having a cheek piece and reins, comprising:

(a) a pair of opposed rein lever members and a mouthpiece interconnecting said rein lever members, (b) each of said rein lever members comprising an elongated shaft having an upper end portion and a lower end portion, (c) means for connecting said lower end portions to the corresponding reins of a bridle, (d) said mouthpiece comprising a broken snaffle bit member having outer end portions, (e) said mouthpiece further comprising a connector member for each shaft having an elongated shank portion and journal means connecting each said connector member to a corresponding said shaft for swiveling movement of said shank portion about the longitudinal axis of said corresponding shaft, (f) coupling means connecting each outer end portion of said bit member to a corresponding shank portion for pivotal and axial movement of said bit member relative to said shank portions, and (g) means for connecting said mouthpiece to the cheek piece of said bridle.

2. The invention according to claim 1 in which each said shank portion is bow-shaped, each said bow-shaped shank portion terminating in said journal means, each said journal means encompassing said corresponding shaft for rotary movement of said shank portion about said corresponding shaft.

3. The invention according to claim 2 in which each said coupling means comprises a collar on each outer end portion of said bit member, said collar slidably and pivotally receiving said corresponding shank portion.

4. The invention according to claim 3 in which each said shank portion has a uniform cross-section, and a plurality of tubular bit spacers slidably mounted upon said shank portion, and means for detachably removing said shank portion from a corresponding sleeve to permit installation and removal of said bit spacers from said corresponding shank portion.

5. The invention according to claim 2 in which each said journal means comprises a sleeve fixed to each end of said bow-shaped shank portion, each said sleeve receiving said shaft for rotary and axial movement.

6. The invention according to claim 5 in which said shaft has a uniform cross section, said shaft being longer than the distance between said sleeves, and further comprising a tubular spacer member detachably received on each said shaft.

7. The invention according to claim 6 in which said means for connecting said lower end portions to the reins of a bridle comprise a pair of rein eyes, each rein eye being detachably connected to the lower end portion of a corresponding shaft, each rein eye being adapted to retain said spacer member on said shaft when the rein eye is attached to the lower end of said shaft and to permit removal of said spacer members and said connector members when said rein eyes are removed from said lower end portions of said shafts.

8. The invention according to claim 6 in which said means for connecting said lower end portions to the reins of a bridle comprises a pair of rein eyes, each rein eye comprising the lower end portion of a corresponding shaft, each rein eye being adapted to retain said spacer member on said corresponding shaft, the upper end of each said corresponding shaft terminating in an upper eye, and means for detachably removing one of either a rein eye or said upper eye in order to install and remove said tubular spacer members and said sleeves to adjustably position each said shank portion on said corresponding shaft.

9. The invention according to claim 5 in which said sleeves comprises an upper sleeve and a lower sleeve for each shank portion, and means detachably connecting one of said sleeves to said bow-shaped shank portion.

10. The invention according to claim 1 in which said means for connecting said mouthpiece to the cheek piece comprises a cheek piece connector member fixed to the shank portion of each said corresponding connector member.

11. The invention according to claim 1 further comprising weight members, and means for detachably connecting one of said weight members on each of said outer end portions of said bit member.

12. The invention according to claim 1 further comprising curb chain eyes at said upper end portion of said shafts and a curb chain connecting said curb chain eyes.

* * * * *